United States Patent [19]

Martin

[11] 4,276,857

[45] Jul. 7, 1981

[54] BOILER CONTROL SYSTEMS

[75] Inventor: Barrie J. Martin, Shenfield, England

[73] Assignee: Plessey Handel und Investments AG, Zug, Switzerland

[21] Appl. No.: 50,056

[22] Filed: Jun. 19, 1979

[30] Foreign Application Priority Data

Jun. 20, 1978 [GB] United Kingdom ..... 27341/78

[51] Int. Cl.[3] ..... F22B 37/42

[52] U.S. Cl. ..... 122/448 R; 431/1; 239/102

[58] Field of Search ..... 431/1, 12, 90; 122/448 R; 239/102, 4

[56] References Cited

U.S. PATENT DOCUMENTS

| | | | |
|---|---|---|---|
| 3,039,699 | 6/1962 | Allen | 431/1 |
| 4,000,852 | 1/1977 | Martin | 239/102 |
| 4,013,223 | 3/1977 | Martin | 239/102 |
| 4,165,961 | 8/1979 | Yamamoto | 431/1 |

*Primary Examiner*—Edward G. Favors

*Attorney, Agent, or Firm*—Fleit & Jacobson

[57] ABSTRACT

A boiler control system comprising an oil burner, one or more electrically-operated oil-injecting devices for injecting oil into a combustion chamber of the oil burner, and switch means for periodically energizing the or each oil-injecting device, and switch-control means for varying the ON/OFF time ratio of the energization of the or each oil-injecting device.

9 Claims, 3 Drawing Figures

BOILER CONTROL SYSTEMS

This invention relates to a boiler control system.

Known heating boilers employ pressure jet atomisers which operate such that when the medium, e.g. water, being heated reaches the required temperature, a thermostat switches a fuel pump off and the boiler combustion unit shuts down. When the temperature of the heated medium drops below the required level, the thermostat senses this and causes the fuel pump to switch on and the combustion unit to re-ignite. It will be apparent but such periodic switching-off and re-ignition of the burner is clearly undesirable.

Modulation of the heat output from the combustion unit could be achieved by varying the pressure supply to the atomisers. This, however, is not a desirable thing to do. More specifically, the combustion unit in the known boilers will be especially designed with primary and secondary air volumes and velocities, such that the fuel oil particle velocity, spray angle and a flame holder are arranged to give a stable combustion zone. If the fuel oil pressure is reduced, the velocity and spray angle will change and so will the position of the flame front and the stability of the combustion.

One possible way of overcoming this problem would be to use a complex mechanical burner nozzle in which an actuator changed the dimensions of metering orifices within the nozzle, so as to reduce the fuel oil flow whilst keeping the fuel oil pressure constant. Such an arrangement would, however, be mechanically very complex and would therfore be costly. It is an aim of the present invention to provide a simpler way of overcoming the above problem.

With this object in view, the present invention provides a boiler control system comprising an oil burner, one or more electrically-operated oil-injecting devices for injecting oil into a combustion chamber of the oil burner, and switch means for periodically energising the or each oil-injecting device, and switch-control means for varying the ON/OFF time ratio of the energisation of the or each oil-injecting device.

Preferably, the or each oil-injecting device is a vibratory device having a ball valve obturator element which is moved by vibration of the device from a position in which it closes an oil passage to a position in which it opens the oil passage. Advantageously, the vibratory device has a piezoelectric crystal for causing the vibration.

Usually, the boiler control system of the present invention will include a heat exchanger, a fan and a fuel pump.

An embodiment of the present invention will now be described solely by way of example and with reference to the accompanying drawings in which.

Figure 1:
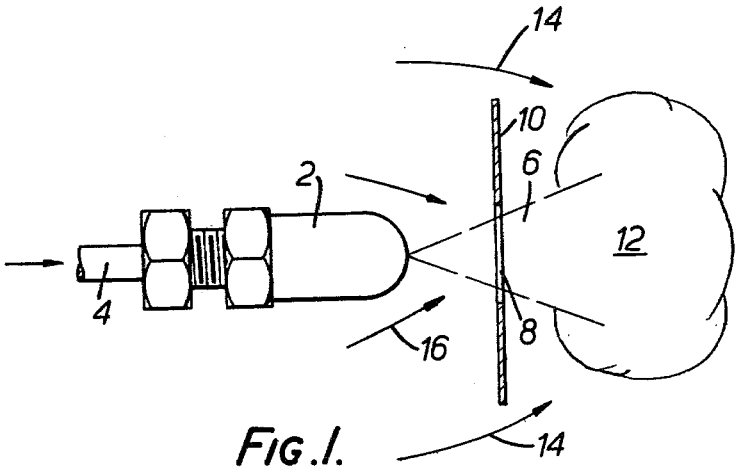
FIG. 1 shows a known boiler control system.

Referring to FIG. 1, there is shown a known boiler control system comprising a nozzle 2 fed with fuel oil from a pipe 4. Fuel oil 6 is sprayed from the nozzle 2 through an orifice 8 in a flame holder 10. The fuel oil 6 is ignited in a combustion zone 12 with the aid of secondary air 14 which passes around the flame holder 10 and primary air 16 which passes through the orifice 8. The boiler control system illustrated in FIG. 1 is repeatedly turned on and off as a means of controlling the temperature of a liquid being heated, the temperature of this liquid being continuously sensed by a thermostat.

Figure 2:
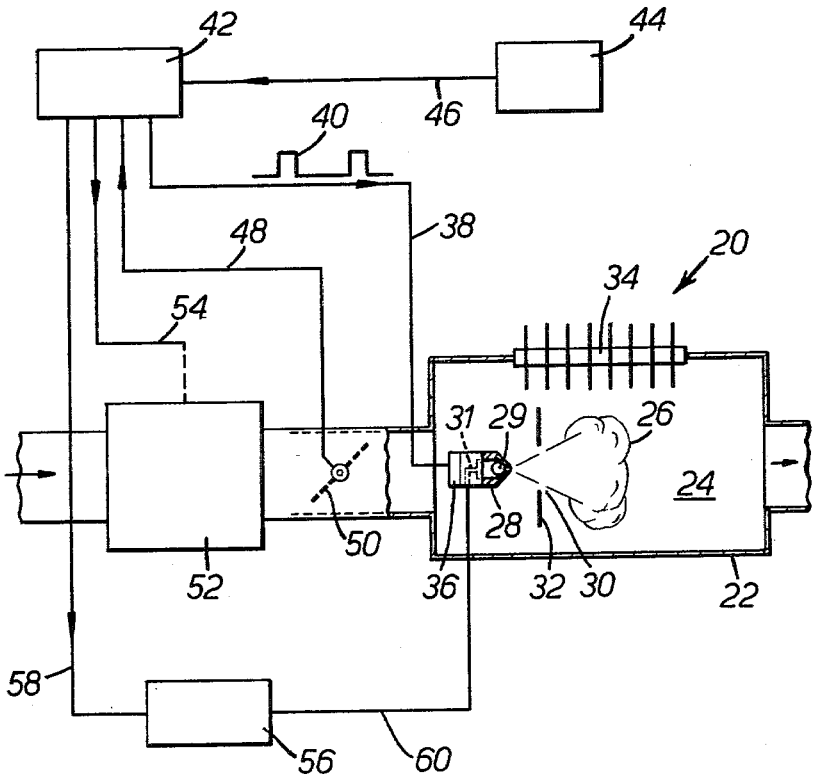
FIG. 2 shows a boiler control system in accordance with the invention.

Referring now to FIG. 2, there is shown a boiler control system 20 which is in accordance with this invention and which comprises an oil burner 22 having a combustion chamber 24. Fuel oil 26 is fed to the combustion chamber 24 from an ultrasonic nozzle 28 which sprays the fuel oil 26 through an aperture 30 of a flame holder 32. The burner 22 is also provided with a heat exchanger 34 as shown.

The ultrasonic nozzle 28 is a vibratory device having a ball valve obturator element 29 which is moved by vibration of the device from a position in which it closes an oil passage 31 to a position in which it opens the oil passage 31. The ultrasonic nozzle 28 also has a piezoelectric device 36 which is fed via a lead 38 with pulsed electronic signals 40 from a control system 42. The signals 40 are illustrated in FIG. 3 and it will be seen that they have ON times 43 and OFF times 45.

The boiler control system 20 further comprises a thermostat 44 for sensing the temperature of the liquid being heated and this thermostat feeds appropriate information into the control system 42 via a lead 46. The control system 42 also receives information via a lead 48 as to the position of a throttle 50. The control system 42 itself gives out information to a fan 52 via a lead 54 for controlling the speed of the fan 52, and to a fuel pump 56 via a lead 58 for controlling the amount of fuel oil pumped by the pump 56 via a fuel oil supply line 60 to the ultrasonic nozzle 28.

Figure 3:
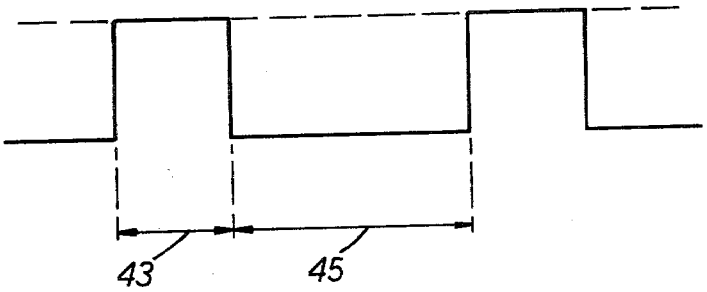
FIG. 3 shows pulses for the boiler control system of FIG. 2.

The boiler control system 20 operates such that the ultrasonic nozzle 28 can be switched on and off at high frequency by electronically controlling the ratio of the ON time 43 to the OFF time 45 as illustrated in FIG. 3. This enables the flow from the ultrasonic nozzle 28 to be varied and hence the heat released from the combustion chamber 24. By varying the fuel oil flow this way, the particle velocity and spray angle are not changed and therefore the combustion process remains stable and consistent, providing certain limits are not exceeded.

Since the combustion within the chamber 24 is continuous, it will be obvious that if the off time is too great, then the flame will either extinguish itself or the air will blow the flame away from the holding area around the flame holder 32. At off times slightly less than this, the flame may be unstable and may create unwanted noise.

It is preferred that the frequency at which the nozzle 28 is switched is kept greater than 40 Hz since this gives stable combustion. Within a minimum response time for the nozzle 28 of about 1 microsecond, a turndown ratio for the burner of 25 to 1 can be achieved.

The fuel flow can be changed by keeping the frequency fixed and varying the ON time or vice versa. It is also possible to vary the air flow to the burner once the device is in operation by use of the throttle 50 or by controlling the speed of the fan 52. The air flow can be measured by a potentiometer on the throttle or as an electrical measurement of the fan characteristics. By appropriately feeding information to the control system 42, the presence of excess air can be avoided, resulting in higher temperatures and better heat transfer from the combustion chamber 24 to the heat exchanger 34.

The use of the ultrasonic nozzle 28 is advantageous in that fuel oil does not dribble from the nozzle 28 when the fuel pump 56 is switched off, this fuel oil dribbling being undesirable since it leads to a carbon deposit build-up on the nozzle.

With presently known fuel oil injectors, injector replacement is high because of contamination of the small fuel oil passages by carbon deposits. By using relatively large passageways for a given flow rate contamination can be cut, and the vibration of the nozzle 28 assists in preventing carbon deposits forming.

It is to be appreciated that the embodiment of the invention described above has been given by way of example only and that modifications may be effected. Thus, for example, the nozzle 28 can employ a spring to return the ball valve obturator element 29 to its seat. Also, the ball valve obturator element 29 can be seated inside the nozzle 28 or outside the nozzle 28. Still further, the nozzle 28 can be constructed to have fuel oil swirl passages and an aperture for allowing fuel to act directly on the ball valve obturator element 29 when it is inside the nozzle 28 to return the ball valve obturator element 29 quickly to its seat when vibration ceases.

What we claim is:

1. An oil-burner system for heating a boiler, comprising a combustion chamber, a burner, constituted by an electrically operated injection device, for injecting fuel oil into the combustion chamber, and electric-circuit means establishing, when connected to an electric-power supply, a circuit for energising the injecting device; said circuit means including switching means operative to periodically close and open such circuit for periodic energisation of the injecting device at a frequency high enough to ensure the maintenance of a steady flame in the combustion chamber, and control means co-operating with said switching means to adjustably vary the ON/OFF ratio of the periodic energisation.

2. A system as claimed in claim 1, wherein said frequency is greater than 40 Hz.

3. A system as claimed in claim 1, which includes more than one oil-injecting device and electric-circuit means for energising each said injecting device.

4. A system as claimed in claim 1, wherein the injection device includes a nozzle and electromechanical transducer means operative when energised to produce longitudinal vibration of the nozzle.

5. A system as claimed in claim 1, wherein said control means include a thermostat device responsive to the boiler temperature and operative to vary said ON/OFF ratio.

6. A system as claimed in claim 1, which further includes adjustable means controlling the rate of flow of combustion air to the burner, and means responsive to the position of said flow-rate control means for varying said ON/OFF ratio.

7. A system as claimed in claim 1, claim 5 or claim 6, which further includes means responsive to said control means to vary the rate of flow of combustion air to the burner.

8. A boiler control system according to claim 1 in which the or each oil-injecting device is a vibratory device having a ball valve obturator element which is moved by vibration of the device from a position in which it closes an oil passage to a position in which it opens the oil passage.

9. A boiler control system according to claim 8 in which the vibratory device has a piezoelectric crystal for causing the vibration.

* * * * *